US006654967B2

(12) United States Patent
Haar

(10) Patent No.: US 6,654,967 B2
(45) Date of Patent: Dec. 2, 2003

(54) THERAPY APPAREL FOR CHILDREN DIAGNOSED WITH SENSORY INTEGRATION DYSFUNCTION

(75) Inventor: Sherry J. Haar, Manhattan, KS (US)

(73) Assignee: Kansas State University Research Foundation, Manhattan, KS (US)

( * ) Notice: Subject to any disclaimer, the term of this patent is extended or adjusted under 35 U.S.C. 154(b) by 0 days.

(21) Appl. No.: 10/167,724

(22) Filed: Jun. 10, 2002

(65) Prior Publication Data

US 2002/0188999 A1 Dec. 19, 2002

Related U.S. Application Data

(62) Division of application No. 09/841,814, filed on Apr. 25, 2001, now Pat. No. 6,401,249.

(60) Provisional application No. 60/199,836, filed on Apr. 26, 2000.

(51) Int. Cl.[7] ..... A42B 1/22; A42B 1/24

(52) U.S. Cl. ..... 2/209.13; 2/205; 2/183; 2/423; 2/417

(58) Field of Search ..... 2/209.13, 209.14, 2/410, 68, 411, 421, 422, 417, 423, 195.1, 195.5, 918, 244, 183, 202, 204, 175.1, 195.2, 205, 5, 6.1, 6.2, 10

(56) References Cited

U.S. PATENT DOCUMENTS 1,148,586 A * 8/1915 Henderson ..... 2/204
2,104,997 A * 1/1938 Lawrence ..... 2/198
2,447,850 A * 8/1948 Feldman ..... 2/204
2,810,913 A * 10/1957 Kennedy ..... 2/204
2,874,387 A * 2/1959 Bannister et al. ..... 2/195.1
2,908,012 A * 10/1959 Feldman ..... 43/57.1
3,106,184 A * 10/1963 Shea ..... 116/209
4,023,212 A * 5/1977 Huffman ..... 2/195.2
4,222,125 A * 9/1980 Sewell-Wood ..... 2/195.1
4,845,782 A * 7/1989 Gregg ..... 2/172
5,075,903 A * 12/1991 Richoux ..... 2/411
5,136,726 A * 8/1992 Kellin et al. ..... 2/244
5,437,064 A * 8/1995 Hamaguchi ..... 2/414
5,509,144 A * 4/1996 Soergel et al. ..... 2/195.1
5,530,970 A * 7/1996 Knutson ..... 2/209.13
5,615,419 A * 4/1997 Williams ..... 2/411
5,682,615 A * 11/1997 Wahl et al. ..... 2/209.13
6,016,572 A * 1/2000 Park ..... 2/195.2
6,094,749 A * 8/2000 Proctor ..... 2/195.2
6,158,053 A * 12/2000 Wang ..... 2/175.1
6,163,888 A * 12/2000 Park ..... 2/183
6,167,569 B1 * 1/2001 Conner, IV ..... 2/209.11
6,170,086 B1 * 1/2001 Lee ..... 2/195.3
6,230,331 B1 * 5/2001 Aguilar et al. ..... 2/209.11
6,237,154 B1 * 5/2001 Reuven ..... 2/171.2
6,240,570 B1 * 6/2001 Wu ..... 2/410
6,256,799 B1 * 7/2001 McGlasson et al. ..... 2/422
6,467,096 B1 * 10/2002 Coluccio ..... 2/195.2
6,484,323 B1 * 11/2002 Pu ..... 2/410

* cited by examiner

*Primary Examiner*—John J. Calvert
*Assistant Examiner*—Alissa L. Hoey
(74) *Attorney, Agent, or Firm*—Hovey Williams LLP

(57) ABSTRACT

Therapy apparel (10) is provided to assist in therapy sessions with children diagnosed with sensory integration dysfunction and impaired motor development. The apparel (10) includes a fabric top (14) to be worn over the shoulders and trunk of a child (12), together with a cape (16) and close-fitting headgear (18). The top (14) has fanciful theme decorations (e.g., a beetle) and is equipped with a series of flexible elastic straps for the feet, knees and hands of the child (12) and which can be used during a therapy session. The cape (18) is likewise theme-decorated and includes handholds (84) allowing the child (12) to spread the cape during imaginative play. The headgear (18) is constructed using padded side and sections (104, 106) with flexible elastic sections (108) between the sections (104, 106), and a chin strap (110) allowing the headgear (18) to be drawn into close conforming relationship with the child's head. A series of individual accouterments (114) can be placed on the headgear at the discretion of the child.

7 Claims, 3 Drawing Sheets

FIG. 5
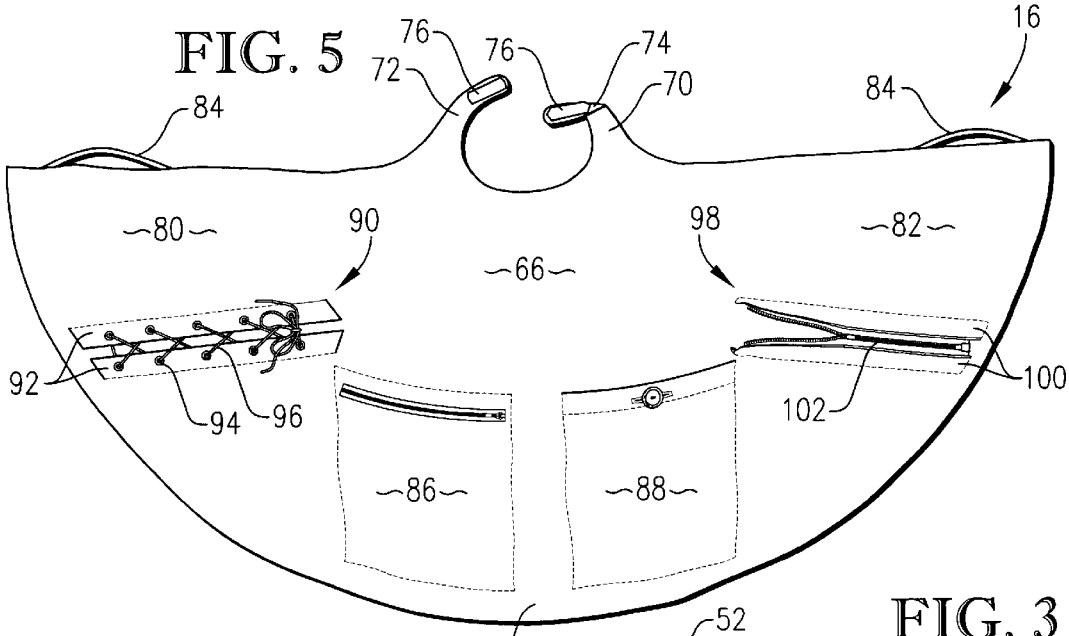
FIG. 3
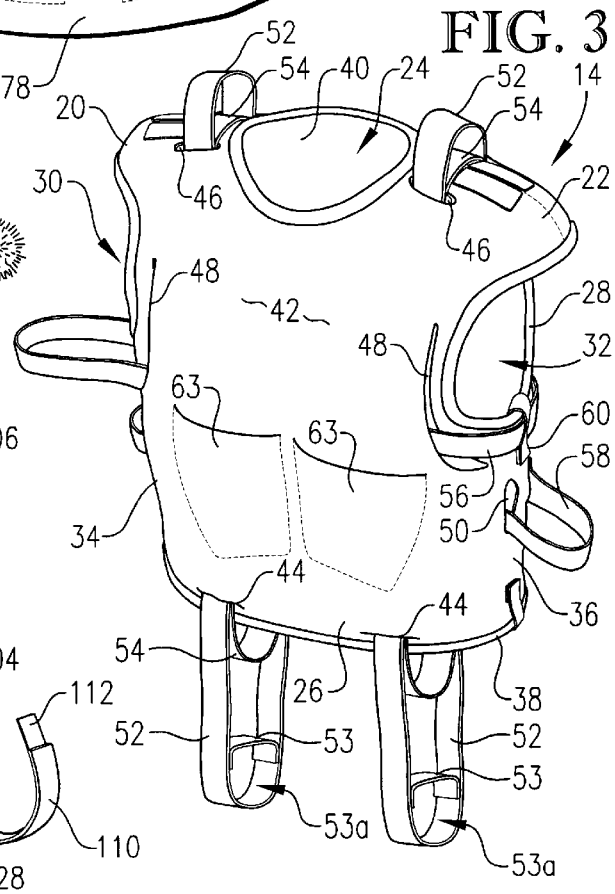
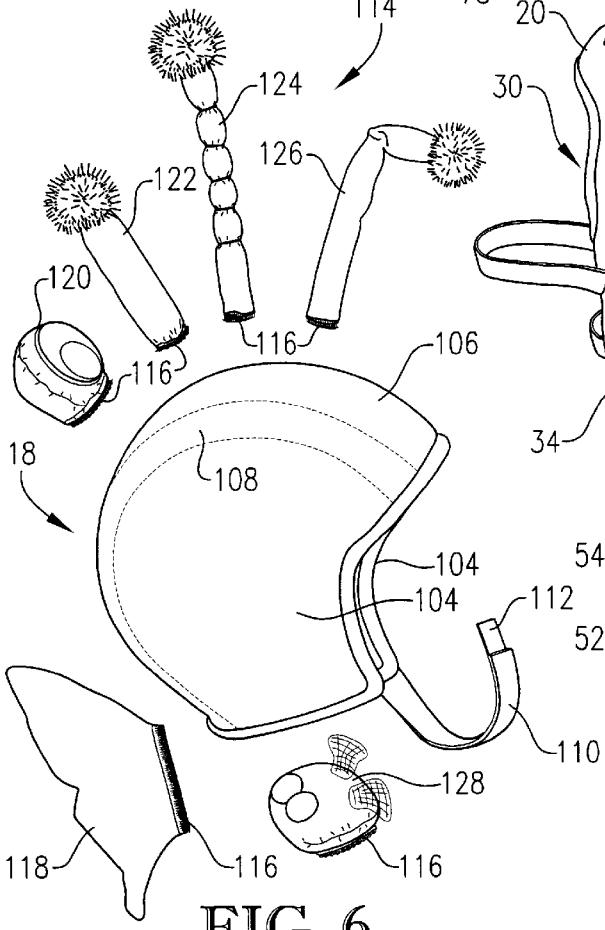
FIG. 6
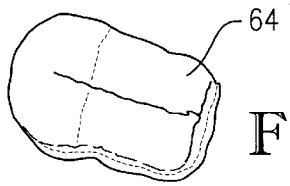
FIG. 7

THERAPY APPAREL FOR CHILDREN DIAGNOSED WITH SENSORY INTEGRATION DYSFUNCTION

RELATED APPLICATIONS

This is a division of application Ser. No. 09/841,814 filed Apr. 25, 2001, now U.S. Pat. No. 6,401,249 claiming the benefit of provisional patent application Ser. No. 60/199,836 filed Apr. 26, 2000, and the entire content of such application is incorporated by reference herein.

BACKGROUND OF THE INVENTION

1. Field of the Invention

The present invention is broadly concerned with therapy apparel for children diagnosed with sensory integration dysfunction and/or impaired motor development. The apparel is designed to be worn during the course of a therapy session, and has been found to yield many benefits to children under such treatment. The preferred therapy apparel includes a top worn over the shoulders and trunk of a child with a series of flexible, stretchable elastic straps designed for selective placement around the child's feet and knees during different therapy exercises, and for grasping and lateral extension by the child. The top is adorned with fanciful theme decorations thereon to arouse the child's interest and fulfill play needs. The overall apparel further includes a cape and specialized, close-fitting headgear, which again are appropriately theme-decorated. The headgear is designed to permit the child to attach various fanciful accouterments to excite the child and enhance motor skill development.

2. Description of the Prior Art

Sensory integrative dysfunction is a developmental disorder defined by deficits in the central processing of proprioceptive, tactile, and vestibular sensory inputs that are not attributable to either peripheral or cortical central nervous system dysfunction. The proprioceptive sense refers to components of muscles, joints, and tendons that provide a person with a subconscious awareness of body position and movement. Children with sensory integration dysfunction may have difficulty maintaining balance in relation to environmental demands and have difficulty with tasks that require opposing muscle groups to work in a coordinated fashion, such as wringing out a wash cloth or pouring milk from a heavy container. The tactile sense interprets applied stimuli such as touch, pressure, pain, and temperature, through tactile receptors found throughout the skin. Some children are overly sensitive to touch, particularly light touch and have a tendency to react negatively and with extreme emotion to some tactile sensations. On the other hand, some children crave tactile input, touching and seeking out input. The vestibular sense is responsible for awareness of body position and movement in space, postural tone and equilibrium, and stabilization of the eyes in space during head movements. The vestibular receptors are located in the inner ear and are stimulated by movement of the head and by gravity. Children with sensory integration dysfunction may have balance difficulties and cannot tolerate or interpret movement, while others seem to crave movement opportunities.

Sensory integration theory postulates that intervention through therapy provides enhanced sensory experience within the context of a meaningful, self-directed activity in order to elicit an adaptive behavior. The result is enhanced sensory integration and, in turn, enhanced learning.

One method of proprioceptive and tactile sensory stimulation is deep pressure or deep touch pressure. Deep touch pressure is the type of surface pressure that is exerted in most types of firm touching, holding, and stroking. One investigator observed this need for deep pressure from a girl with autism as she would hug her mother with strong, firm hugs. Her mother indicated that her child favored clothing that covered her limbs and was made from cotton knit fabric. Her mother would often dress the child in a jumper or skirt over cotton knit, flowered longjohns. The need to cover the limbs with fabric that hugs the body is characteristic of the child who needs continuous tactile input. In contrast, a four-year-old male with autism was observed who did not like clothing. He would remove his shirt, socks, and shoes, and pull his pant legs up as far as possible. These are characteristic of tactile defensiveness.

Weighted vests, weighted collars, weighted arms and leg bands, lap and shoulder weights, and weighted quilts are available for treating deep pressure needs. One investigator conducted a pilot study applying weighted vests with two samples, children with autism and children without autism. The non-autistic children reported that wearing the vest made them feel sleepy, but showed no appreciable change in pulse or blood pressure; whereas, the children with autism had measurable drops in both pulse rate and blood pressure reading. While the wearing of weighted vests are increasing in elementary schools and therapy treatment programs, the outcomes of wearing weighted vests are largely anecdotal and few parameters exist to guide the use of the vests.

Gloves and pressure vests have been shown to reduce self-stimulatory behaviors of a young girl with autism. Similarly, self-injurious and self-stimulating behaviors of a boy with autism were reduced while wearing arm splints and elastic bandages. A calming effect provided by the direct pressure has been reported.

An adult with autism has reported that deep pressure applied to her body provides a calming effect. A squeeze machine was designed to provide great amounts of pressure over her body. The squeeze machine's pressure also had a relaxing effect on adults without disability. Use of the squeeze machine also led to a reduction in hyperactivity in four of nine children.

The foregoing indicates that deep pressure and tactile input is calming for children with sensory impairments and that apparel and textile products may be used as therapeutic aids.

While the foregoing expedients have been used in the past in an attempt to provide appropriate therapy for children diagnosed with sensory integration dysfunction, the prior apparel and the like has not fulfilled the play and imaginative needs of small children; moreover, the prior therapy garments do not generally provide the full range of desirable therapy inputs for the treatment of sensory integration dysfunctions.

SUMMARY OF THE INVENTION

The present invention overcomes the problems outlined above and provides therapy apparel for small children diagnosed with sensory integration dysfunction and impaired motor development. Broadly speaking, the therapy apparel includes a flexible top adapted to be worn over the shoulders and trunk of a child requiring therapy, with the top having upper shoulder sections and a neck opening therebetween, and front and rear panels depending from the shoulder sections and presenting lower margins. The top includes a pair of flexible, stretchable first straps extending below the panel lower margins with each first strap being of a length for selective coupling with a respective one of the child's feet while the child is standing. In this orientation, the first straps cause the top and straps to be pulled downwardly to provide deep pressure therapy input. Preferably, each of the first straps is in the form of a continuous loop passing adjacent a shoulder section of the top and with the lower end of each loop adapted for passing under a respective foot of the child; in this way, upwardly directed forces are generated to give upward pressure and proprioceptive input.

In further preferred forms, the top has a pair of flexible, stretchable second straps likewise extending below the lower margin of the top with each second strap being of a length for selective coupling with a respective one of the child's knees when the child is in a tall kneeling position; these second straps are also configured to cause the top strap to be pulled downwardly in this orientation. The second straps are likewise in the form of continues loops which pass adjacent a shoulder section and with the lower end of the loops adapted for coupling with the child's knees, to generated upwardly forces. Finally, the top also includes a third pair of flexible, stretchable, loop-type lateral straps each selectively extensible in opposed lateral directions beyond the side sections of the top and grasped by the child. These lateral straps when extended cause the top to be pulled in corresponding lateral directions, creating resistance against the child's hand, wrist, elbow and shoulder joints and coordinating muscles.

The front and rear panels of the top are preferably provided with fanciful theme decorations thereon, such as insects (e.g. beetles), aquatic animals with fins, scales and eyes, animals having horns, ears, noses, eyes and tails, royalty with crowns, and wands, workers such as firemen, policemen, mail carriers, construction workers and cowboys, and shapes, colors and textures of various types (squares, circles, triangles, ovals and the like). Furthermore, in order to provide a further measure of deep pressure input, the front and back panels of the top are provided with pockets which receive weights of various sizes.

The preferred apparel also includes a cape to be worn over the top with the cape having a neckpiece and a pair of opposed, outwardly extending wing sections, the latter each having a handhold. The outer surface of the cape is equipped with differently manipulable objects which can be grasped and used by the child, in order to provide fine motor development. The outer surface of the cape is also preferably decorated in a manner corresponding to the decorations provided on the apparel top Finally, the therapy apparel includes headgear which is stretchable and equipped with a chin strap so that the headgear may be drawn tightly around the child's head. The headgear further has a plurality of different, fanciful accouterments each attachable to the exterior surface of the headgear at the discretion of the child. For this purpose, a headgear preferably has a central panel and opposed side panels, with stretchable fabric interconnecting the panels; the outer surface of the panels, and the corresponding ends of the accouterments, have mating hook and loop Velcro® fabric sections.

The therapy apparel of the invention allows full body movement by the child to facilitate participation in all occupational activities and use of occupational/physical therapy equipment. Moreover, the apparel provides opportunities for active proprioceptive input, allows for passive and deep pressure proprioceptive input, promotes use of equipment to provide vestibular input and generates desirable tactile input. Use of the therapy apparel promotes gross, fine and perceptual motor skills along with motor planning up to three stages, and enhances transitions without behavior resistance from the child between activities, thus aiding in the wearer's self-organization and attention to task. Finally, the apparel meets the play needs of the child, with structures and forms revolving around play themes favored by children.

BRIEF DESCRIPTION OF THE DRAWINGS

FIG. 3 is a perspective view of the preferred therapy apparel top;

FIG. 5 is a plan view of the preferred cape forming a part of the apparel, viewing the outer surface thereof;

FIG. 6 is an exploded view of the preferred headgear, with various of the attachable accouterments disposed about the outer surface of the headgear;

FIG. 7 is an elevational view of a weight adapted to be used with the top.

DETAILED DESCRIPTION OF THE PREFERRED EMBODIMENT

Figures 1, 2:
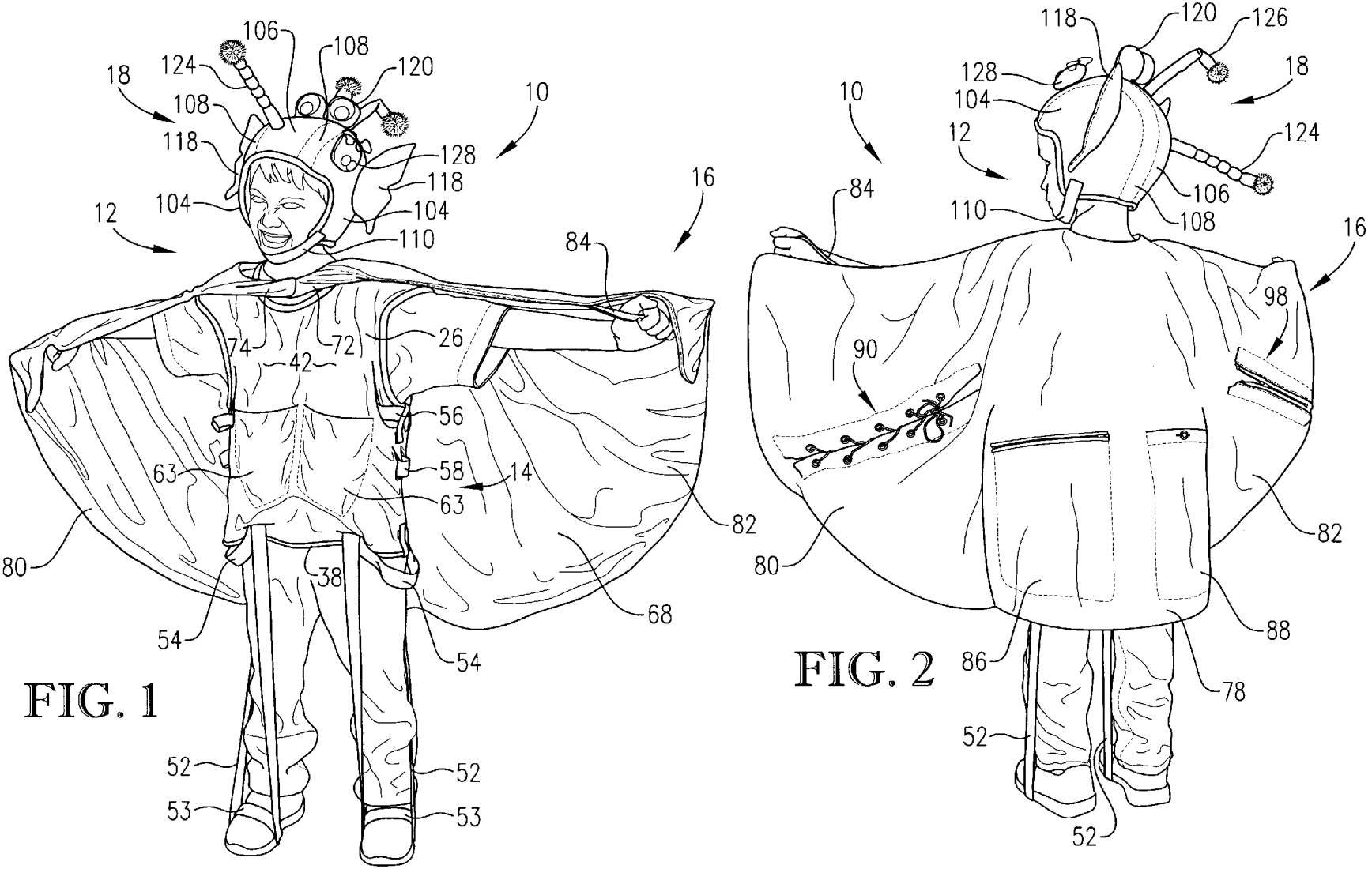
FIG. 1 is a front pictorial view of a child wearing the preferred therapy apparel of the invention, shown with the child extending the cape and with the stretchable foot straps of the top in an extended condition coupled with the child's feet.
FIG. 2 is a rear pictorial view similar to that of FIG. 1, showing the outer surface of the cape and features of the headgear.

Turning now to the drawings, and particularly FIGS. 1 and 2, therapy apparel broadly referred to by the numeral 10 is provided, which is worn by a child 12. Broadly speaking, the apparel 10 includes a sleeveless fabric top 14 to be worn over the shoulders and trunk of the child 12, a fabric cape 16 and a flexible, close-fitting headgear 18.

In more detail, the top 14 (see FIG. 3) includes a pair of upper padded raglan shoulder sections 20, 22 with a neckhole 24 therebetween, and a pair of depending front and rear panels 26, 28 depending from the shoulder sections 20, 22. A pair of large arm holes 30, 32 are formed below the shoulder sections 20, 22, with respective side sections 34, 36 below the corresponding arm holes. The panels 26, 28 and the side sections 34, 36 form a continuous lower margin 38 as shown.

The entire top 14 is constructed to have a lining 40 formed of appropriately sewn-together fabric (e.g., cotton spandex knit), an interlining to internally organize the straps (polyester knit interfacing), as well as a fabric exterior 42 which is likewise sewn-together. The fabric exterior 42 is formed using any desired fabric such as gold spandex, and is adorned with fanciful theme decorations, such as a "beetle" design on the front and rear panels. In addition, a series of openings are provided in the fabric 42 for receipt of stretchable straps which extend between the outer fabric exterior 42 and the lining 40. In particular, lower slit openings 44 are provided in the front and rear panels adjacent margin 38, along with upper slit openings 46 on opposite sides of each shoulder section 20, 22. Elongated lateral slits 48 are provided on the front and rear panels adjacent the arm holes 30, 32. Finally, somewhat shorter lateral slits 50 are formed in the side sections 34, 36.

The slits 44–50 accommodate a total of three pairs of elongated, continuous-loop stretchable straps formed of elastic, which extend through corresponding channels in the top which are interlined with polyester knit interfacing. Specifically, a first pair of leg straps 52 extend through the slits 44 and 46, so that the upper ends of the straps 52 overly the corresponding shoulder sections 20, 22 and extend below margin 38. As illustrated, each of the straps 52 has a short, flexible elastic segment 53 adjacent the lower end thereof, defining corresponding foot-receiving openings 53*a*. A second set of somewhat shorter knee straps 54 are threaded through the slits 44 and 46 but lie within the confines of the longer leg straps 52. In the preferred embodiment, the straps 52 have a hanging length of about 27½ inches when relaxed, whereas the knee straps 54 have a relaxed hanging length of about 20½ inches. A hold-down strap 55 is secured at the lower margin side in order to hold straps 52 and 54 when not in use.

A pair of upper and lower lateral continuous loop straps 56, 58 are also supported by the top 14, and in the illustrated embodiment have a relaxed length of 23 inches. As illustrated, the upper strap 56 extends through the arcuate slits 48, whereas the lower strap 58 passes through the slits 50. A hold down strap 60 is secured to the top 14 at the lower sections of armholes 30, 32 in order to hold straps 56 and 58 in place when not in use. The hold down straps 60 are selectively releasable via hook and loop (Velcro®) material respectively secured to the inner surface of the straps 60 and the outer fabric of the top 14.

Figure 8:
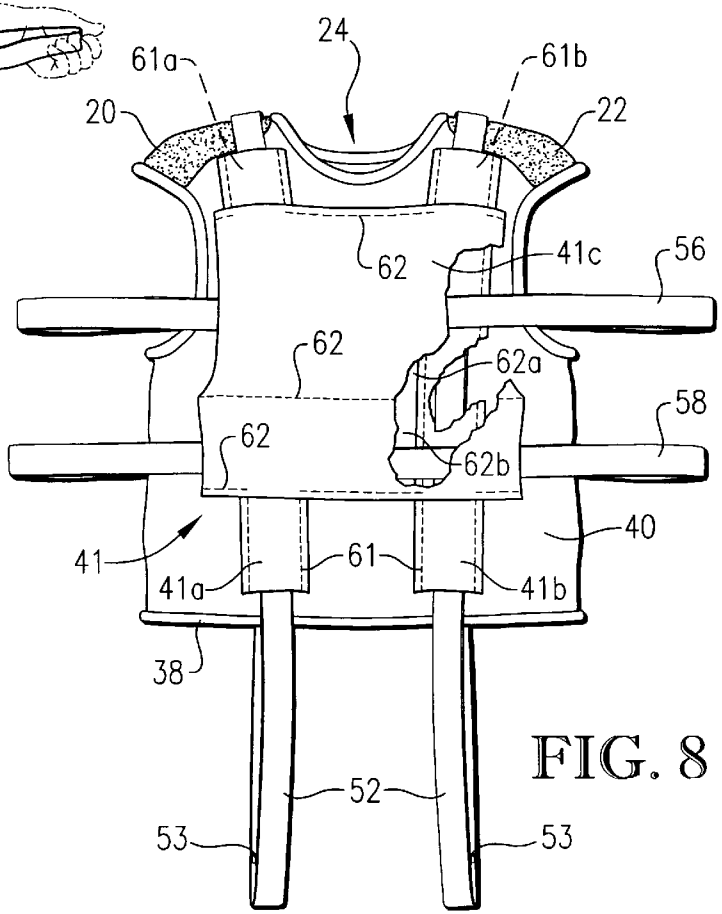
FIG. 8 is a front view of interior portions of the apparel top, with parts broken away to illustrate the attachment of the straps to the top.
Figure 4:
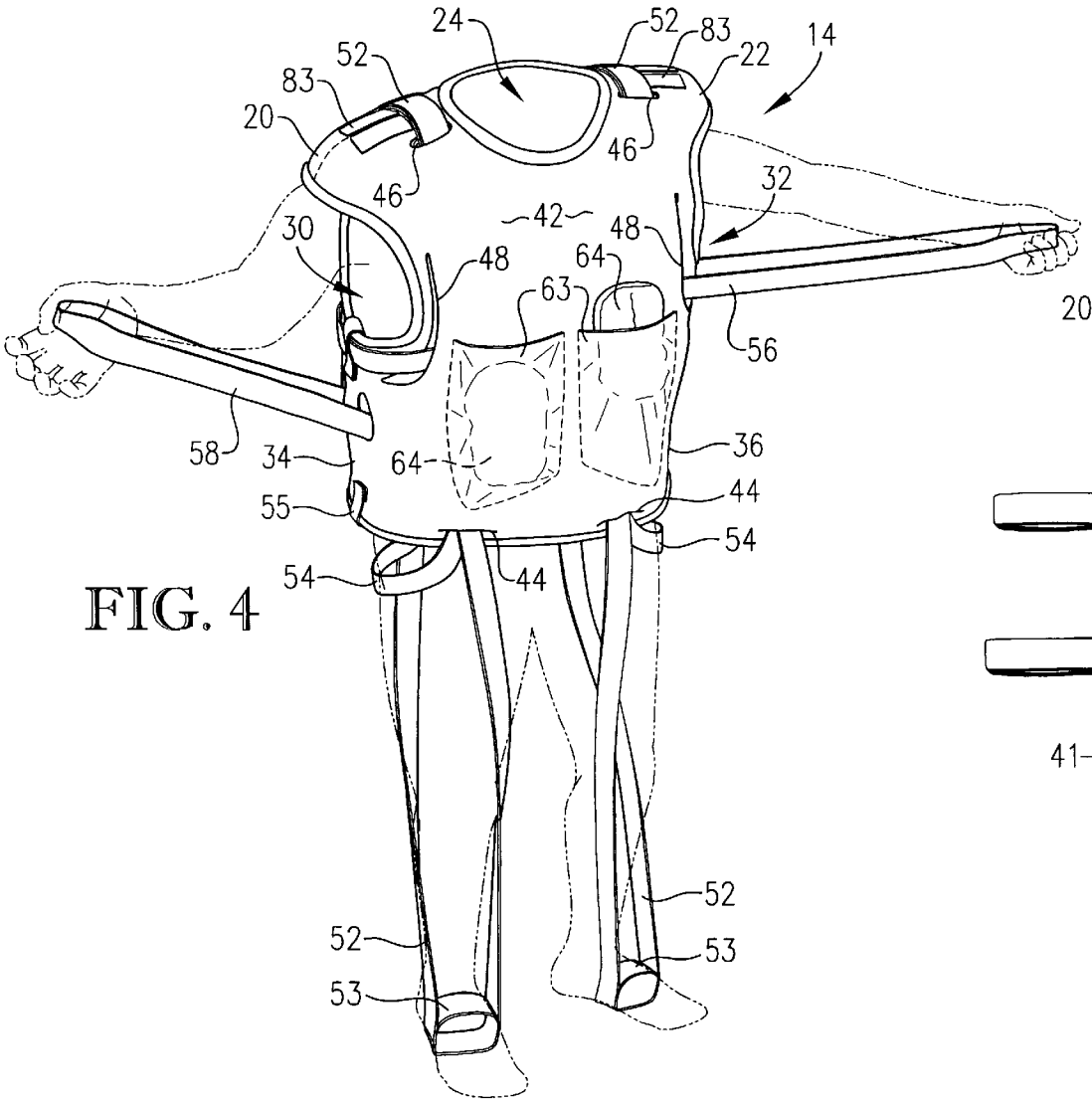
FIG. 4 is another perspective view of the apparel top, shown during use thereof via phantom lines.

Referring to FIG. 8, it will be seen that the interlining 41 includes pieces 41*a*–41*c* preferably formed of polyester knit interfacing which are attached to lining 40. The upright pieces 41*a* and 41*b* extend from the shoulder regions downwardly towards margin 38 and are sewn with stitching 51 to define corresponding open-ended strap channels 61*a* and 61*b* which receive the straps 52 and 54 (straps 54 are not shown in FIG. 8). The piece 41*c* overlies the pieces 41*a* and 41*b* and is attached by stitching 62 defining upper and lower open-ended, lateral channels 62*a* and 62*b* which respectively receive straps 56 and 58. Although not illustrated, it will be appreciated that the rear panel of the lining 40 is also equipped with interlining as shown in FIG. 8, so that the loop straps 57–58 are supported front and rear.

Each of the front and rear panels 26, 28 of top 14 is equipped with a pair of side-by-side open top pockets 63 which are designed to receive weights 64. Such weights 64 preferably correspond with the fanciful theme of the surface decoration of the top 14. For example, in the case of the "beetle" theme, the weights 64 would be in the form of baby bugs having a surface decoration including fabric "wings" as well as extensible "feelers" (not shown). The weights 64 may be provided in different sizes (e.g. ¼ and ½ pound) are preferably formed of fabric and are filled with metal pellets or other weighting material.

The overall apparel 10 further includes a fabric cape 16 having an exterior fabric surface 66 and an inner lining surface 68. Again, the exterior surface 66 is advantageously consistent in its design with the fanciful theme of top 14. In the illustrated embodiment, this exterior surface would have a similar "beetle" design along the central portion of the cape outer surface. In more detail, the cape 16 has a central neckpiece 70 made up of a pair of selectively interconnectable straps 72, 74 provided with matable hook and loop fabric pieces 76. In addition, the cape has a central section 78 as well as outwardly extending wing sections 80 and 82. The inner surface 68 of the cape has a pair of hand holds 84 on the wing sections 80, 82 which can be grasped by the child to extend the cape, as shown in FIGS. 1 and 2. The inner lining of the cape has a pair of Velcro® straps designed to mate with corresponding Velcro® straps 83 provided on the shoulder sections 20, 22 of top 14.

The outer fabric surface 66 of the cape 16 is also provided with differently manipulable objects which can be manipulated and used by the child. Specifically, the central section 78 has a zippered pocket 86 as well as an adjacent button-closed pocket 88. The wing section 80 has a lacing assembly 90 made up of a pair of elongated fabric sections 92 provided with eyelets 94; a lacing 96 is threaded through the eyelets 94 and conventionally knotted. The wing section 82 on the other hand has a zipper assembly 98 made up of a pair of fabric sections 100 interconnected by an elongated separating zipper 102.

The headgear 18 is designed as a close-fitting head covering and includes a pair of padded side panels 104 and a padded central panel 106. The panels 104–106 are formed of padded fabric with the exterior surfaces thereof formed of Velcro® loop material. A pair of elongated, stretchable elastic sections 108 interconnect the central panel 106 and side panels 104, so as to allow a stretch fit on the head of a child. A chin strap 110 having a mating Velcro(t outer end 112 extends between the side panels 104 and allows the headgear to be drawn tightly around the child's head.

The headgear 18 is also provided with a plurality of different, fanciful accouterments 114 each having a base 116 formed of mating Velcro® fabric, allowing the respective accouterments to be attached to any desired point on the panels 104 or 106, at the discretion of the child. The accouterments 114 can be of virtually any appropriate configuration, consistent with the fanciful decorations on the top 14 and cape 16. In the exemplary embodiment, it will be seen that the accouterments 114 include wings 118, eyes 120, antennae 122, 124 and 126 of various sizes and configurations, and small weighted bugs 128.

In use, the therapy apparel is donned by the child, with assistance from the therapist. First, the top 14 is put on, with the therapist selecting appropriate weights 64 for insertion into the pockets 63. Thereupon, the cape 16 and headgear 18 are donned, with the chin strap of the latter being drawn to ensure that the headgear is in close fitting relationship to the child's head. The child is then encouraged to decorate the headgear 18 with accouterments 114 at the child's discretion. This is of course readily accomplished owing to the construction of the accouterments having bases 116 which are attachable to the outer surface of the headgear 18.

The headgear 18 provides low level protection and sensory input and integration (tactile, proprioceptive and vestibular). The opportunity to decorate the headgear 18 with accouterments 114 gives motor development opportunities, appeals to the play needs of the child and enhances the opportunity for social interaction.

Actual observations of children wearing the therapy apparel of the invention demonstrates that the garments enable children to function at a higher attention level and skill level during therapy. One subject had difficulty managing his behavior, organizing himself and staying on task. When wearing the apparel, there was a noticeable improvement in the subject's behavior, which is believed to have occurred because the elastic straps and/or weights provided the correct amount of arousal, modulation and discrimination, all leading to skill output. Another major benefit was that use of the Bootstraps 52 notably decreased the subject's toe walking.

The fanciful design on the apparel promoted the use of vestibular integrating suspended equipment. Several subjects pretended they were "flying" and used suspended swings as flying vehicles. The duration of time the subjects spent in the suspended equipment increased with continued wearing of the therapy apparel.

A variety of tactile opportunities were provided by the various different fabrics and other different materials used in the construction of the apparel. As the children interacted with the apparel they received tactile input from the elastic straps, hugging the cape 16 to their bodies, throwing the bug weights, placing items in the top and cape pockets, and manipulating the cape's zippers, button and lacing assembly.

Fine and perceptual motor skill activity in the subjects increased by interaction with the cape's fastening system and the zippers, button, button hole, Velcro® sections and lacing. Resistance-free transitions were observed between gross motor and fine motor activities and motor planning was promoted by using the cape to store fine motor activities. The subjects planned activities retrieved the objects for the activities, stored objects in the cape's pockets, participated in gross motor activity and then removed the objects from the cape's pockets for fine motor activity. Using the top and cape pockets promoted smooth transitions and organization of the wearer.

The play needs of the wearers were satisfied with the "bug superhero" theme, and the apparel stimulated the desire to engage in imaginative play while also allowing the therapist to incorporate therapy goal activities.

We claim:

1. Therapy apparel for a child, comprising a headgear adapted to be worn on the child's head, said headgear being stretchable and presenting an outer surface, a central panel, and a pair of side panels with a chin strap interconnecting the side panels and allowing the headgear to be drawn tightly around the child's head, two stretchable fabric panels interconnecting said central panel with each respective side panel, and a plurality of different, fanciful accouterments each attachable to the outer surface of said headgear at the discretion of the child.

2. The apparel of claim 1, each of said accouterments having a base, with the base of each accouterment and corresponding portions of said headgear outer surface being cooperatively configured for releasable attachment of the accouterments.

3. The apparel of claim 2, said headgear portions and accouterment bases equipped with complemental hook and loop fabric.

4. The apparel of claim 1, at least certain portions of said headgear being padded.

5. The apparel of claim 1, said side and central panels being independently displaceable with respect to each other so that said headgear may be worn by children having different head sizes.

6. The apparel of claim 1, said side panels constructed to be in complete covering relationship with the ears of the child wearing said apparel.

7. Therapy headgear for a child comprising a central panel, a pair of side panels, a pair of stretchable fabric panels interconnecting said central panel with each respective side panel, and a chin strap interconnecting the side panels and allowing the head gear to be drawn tightly around the child's head, said panels presenting forward sections located proximate the child's forehead when said headgear is being worn and rearward sections located proximate the base of the child's head when said headgear is being worn, said stretchable fabric panels being interconnected with said side and central panels for substantially the entire length between said forward and rearward sections thereof, said headgear further comprising a plurality of different, fanciful accouterments each attachable to said side and central panels.

* * * * *